US011536442B1

(12) United States Patent
Ruan

(10) Patent No.: US 11,536,442 B1
(45) Date of Patent: Dec. 27, 2022

(54) POWER STRIP WITH NIGHT LIGHT FUNCTION

(71) Applicant: Lidan Ruan, Zhejiang (CN)

(72) Inventor: Lidan Ruan, Zhejiang (CN)

( * ) Notice: Subject to any disclaimer, the term of this patent is extended or adjusted under 35 U.S.C. 154(b) by 0 days.

(21) Appl. No.: 17/885,930

(22) Filed: Aug. 11, 2022

(30) Foreign Application Priority Data

Jul. 27, 2022 (CN) ..... 202210890970.8

(51) Int. Cl.
*F21V 23/06* (2006.01)
*F21Y 115/10* (2016.01)

(52) U.S. Cl.
CPC ..... *F21V 23/06* (2013.01); *F21Y 2115/10* (2016.08)

(58) Field of Classification Search
CPC ..... F21V 23/02; F21V 23/06; F21Y 2115/10; H01R 13/7175; H01R 25/006
See application file for complete search history.

(56) References Cited

U.S. PATENT DOCUMENTS

| | | | | |
|---|---|---|---|---|
| 6,811,281 | B1 | 11/2004 | Hsiao | |
| 7,961,111 | B2 * | 6/2011 | Tinaphong | H02H 9/042 340/649 |
| 10,508,784 | B2 | 12/2019 | Chien | |
| 11,333,345 | B1 | 5/2022 | Chen | |
| 2016/0003431 | A1 | 1/2016 | Chien | |
| 2018/0316201 | A1 * | 11/2018 | Miller | H02J 7/0042 |
| 2020/0091748 | A1 * | 3/2020 | Chien | H02G 3/14 |

* cited by examiner

*Primary Examiner* — Peggy A Neils

(57) ABSTRACT

Disclosed is a power strip with a night light function. An LED light group is arranged based on a traditional power strip, powered by a power supply unit led out between a live wire and a neutral wire in a plug/socket, and controlled by a control unit for work. As arranged on the plug and/or socket, the LED light group can be controlled to be turned on when light is dark. The power strip is convenient to find, plug and use, and can serve as a night light for lighting at night. The control unit respectively has automatic, normally open and normally closed control modes which can be switched by a user toggling a mode switching switch as required. The design of the power strip facilitates use in dark environments and adds a new function, thereby having the advantages of simple structure, reasonable design, convenient use and diversified functions.

8 Claims, 4 Drawing Sheets

POWER STRIP WITH NIGHT LIGHT FUNCTION

CROSS REFERENCE TO RELATED APPLICATION

This application claims priority benefit of Chinese invent Application No. 202210890970.8, filed on Jul. 27, 2022, and the entire contents of which are incorporated herein by reference.

FIELD OF TECHNOLOGY

The present disclosure relates to the technical field of a power strip, and particularly to a power strip with a night light function.

BACKGROUND

A power strip mainly includes a plug, a movable socket, and a power cord for connecting the plug with the movable socket, wherein the movable socket can expand the type and number of jacks through the multi-jack design, and the length design of the power cord can adaptively extend the socket of the power supply, so that the application range of the socket is broadened, the use distance of the socket is expanded, convenience is brought to people, and the power strip is an essential electrotechnical product in electrical work and family life.

Although existing power strips have various types, such as a multi-jack power strip with a switch and a power strip with a USB interface, and can be suitable for different tools and household appliances. However, the existing power strips have a drawback, that is, it is difficult to find the location and perform plug connection operation. Since the power strips can be flexibly moved, in dark environment, it is difficult to find the power strip, and it is also difficult to accurately insert a plug into a corresponding jack after the power strip is found.

Therefore, whether to improve the power strip to facilitate use at night has become an urgent problem to be solved.

SUMMARY

In view of this, the present disclosure provides a power strip with a night light function, so as to solve the problem of inconvenient use caused by the fact that an existing power strip is difficult to be found in a dark environment and a plug cannot be accurately inserted into a corresponding jack after the power strip is found.

A technical solution provided by the present disclosure is specifically as follows: a power strip with a night light function includes a plug, a movable socket, and a power cord for connecting the plug with the movable socket, and the power strip further includes: a night light function module, wherein the night light function module includes an LED light group, a power supply unit, a control unit and a mode switching switch;

the LED light group is mounted in the plug and/or the movable socket;

a first input terminal of the power supply unit is connected to a live wire in the plug/movable socket, a second input terminal of the power supply unit is connected to a neutral wire in the plug/movable socket, and a power supply output terminal of the power supply unit is connected to a positive electrode of the LED light group;

a power supply terminal of the control unit is connected to the power supply output terminal of the power supply unit, an output terminal of the control unit is connected to a negative electrode of the LED light group, and the control unit realizes on/off control of the LED light group by controlling a negative electrode potential of the LED light group; and an output terminal of the mode switching switch is connected to an input terminal of the control unit, the control unit is triggered by the mode switching switch to be switched in automatic, normally open and normally closed control modes, the automatic mode is to automatically control the LED light group to be turned on/off according to a current light intensity, the normally open mode is to control the LED light group to be turned on all the time, and the normally closed mode is to control the LED light group to be turned off all the time.

Preferably, the power supply unit includes: a step-down capacitor, a first resistor, a rectifier bridge, an electrolytic capacitor, a second resistor, a Zener diode and a third resistor;

one terminal of the step-down capacitor is connected to the live wire;

the first resistor is connected to two terminals of the step-down capacitor in parallel;

one alternating current input terminal of the rectifier bridge is connected to the other terminal of the voltage-stabilizing capacitor, and the other alternating current input terminal is connected to a fusible resistor and then is connected to the neutral wire;

two terminals of the electrolytic capacitor are connected to a positive output terminal and a negative output terminal of the rectifier bridge respectively;

the second resistor is connected to two terminals of the electrolytic capacitor in parallel; and a positive electrode of the Zener diode is connected to the negative output terminal of the rectifier bridge, and a negative electrode of the Zener diode is connected to the third resistor and then is connected to the positive output terminal of the rectifier bridge.

Further preferably, the control unit includes: a chip power supply circuit, a sensing circuit, an output circuit, a control chip and a power supply capacitor;

an input terminal of the chip power supply circuit is connected to the power supply output terminal of the power supply unit, and a voltage output by the power supply unit is reduced to supply power for the control chip;

the sensing circuit detects an illumination intensity in real time;

the output circuit is used to output a control signal of the control chip, and an output terminal of the output circuit is connected to the negative electrode of the LED light group; and a power supply pin of the control chip is connected to a power supply output terminal of the chip power supply circuit, power is supplied by the chip power supply circuit, the power supply pin of the control chip is further connected to the power supply capacitor, an output terminal of the control chip is connected to an input terminal of the output circuit to output a control signal; an input pin of the control chip is connected to the output terminal of the mode switching switch and an output terminal of the sensing circuit, the control chip is triggered by the mode switching switch to switch control modes, and when the control mode of the control chip is an automatic mode, the control chip controls the LED light group to be turned on and off according to a detection signal transmitted by the sensing circuit.

Further preferably, the chip power supply circuit includes: a voltage-stabilizing chip, a third capacitor and a fourth capacitor;

a power supply pin of the voltage-stabilizing chip is connected to the power supply output terminal of the power supply unit to reduce a voltage output by the power supply unit;

one terminal of the third capacitor is connected to a grounding pin of the voltage-stabilizing chip and the other terminal of the third capacitor is connected to a voltage output pin of the voltage-stabilizing chip; and one terminal of the fourth capacitor is connected to the power supply pin of the voltage-stabilizing chip and the other terminal of the fourth capacitor is grounded.

Further preferably, the sensing circuit includes: a fourth resistor and a photoresistor;

one terminal of the fourth resistor is connected to the power supply output terminal of the chip power supply circuit; and one terminal of the photoresistor is grounded, and the other terminal of the photoresistor is connected to the other terminal of the fourth resistor and an input pin of the control chip.

Further preferably, the output circuit includes: a fifth resistor and a triode;

one terminal of the fifth resistor is connected to an output pin of the control chip; and a base electrode of the triode is connected to the other terminal of the fifth resistor, an emitter electrode of the triode is grounded, and a collector electrode of the triode is connected to the negative electrode of the LED light group.

Further preferably, the LED light group is formed by six LED light strings connected in parallel, and each of the LED light strings is formed by three LED light strings connected in series.

Further preferably, the mode switching switch is a single-pole double-throw switch.

According to a power strip with a night light function provided by the present disclosure, an LED light group is arranged on the basis of a traditional power strip. The LED light group is powered by a power supply unit led out between a live wire and a neutral wire in a plug/socket, and is controlled by a control unit for work. Since the LED light group is arranged on the plug and/or the socket, the LED light group can be controlled to be turned on when light is dark. On one hand, it is convenient to find the position of the power strip, and plug operation and use are facilitated; and on the other hand, the power strip can serve as a night light for lighting at night. The control unit in the power strip is respectively provided with automatic, normally open and normally closed control modes. A user may switch the three different control modes by toggling the mode switching switch according to actual requirements. When the control unit is switched to the automatic control mode, the control unit will detect the illumination intensity of the current environment in real time and compare the illumination intensity value with a threshold. If the illumination intensity value is less than the threshold, the control unit will control the LED light group to be turned on, otherwise, the LED light group will be turned off, thereby achieving the automatic on/off function of the LED light group. When the control unit is switched to the normally open control mode, the control unit will control the LED light group to be turned on all the time. When the control unit is the normally closed control mode, the control unit will control the LED light group to be turned off all the time. Due to the design of the novel power strip, it is convenient for the power strip to be used in dark environments, and a new function is added for the power strip.

The power strip with the night light function provided by the present disclosure has the advantages of simple structure, reasonable design, convenient use and diversified functions.

It should be understood that the above general description and the following detailed description are only exemplary and explanatory, and cannot limit the present disclosure.

BRIEF DESCRIPTION OF THE DRAWINGS

The accompany drawings constituting a part of this application provide further understanding of the present disclosure. The schematic embodiments of the present disclosure and description thereof are intended to be illustrative of the present disclosure and do not constitute an undue limitation of the present disclosure.

The accompanying drawings herein are incorporated into the specification and constitute a part of the specification, show embodiments consistent with the present disclosure, and are used to explain the principle of the present disclosure together with the specification.

Figure 1:
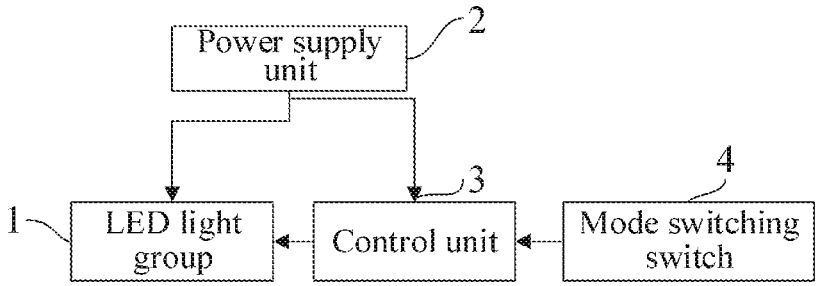
Figure 2:
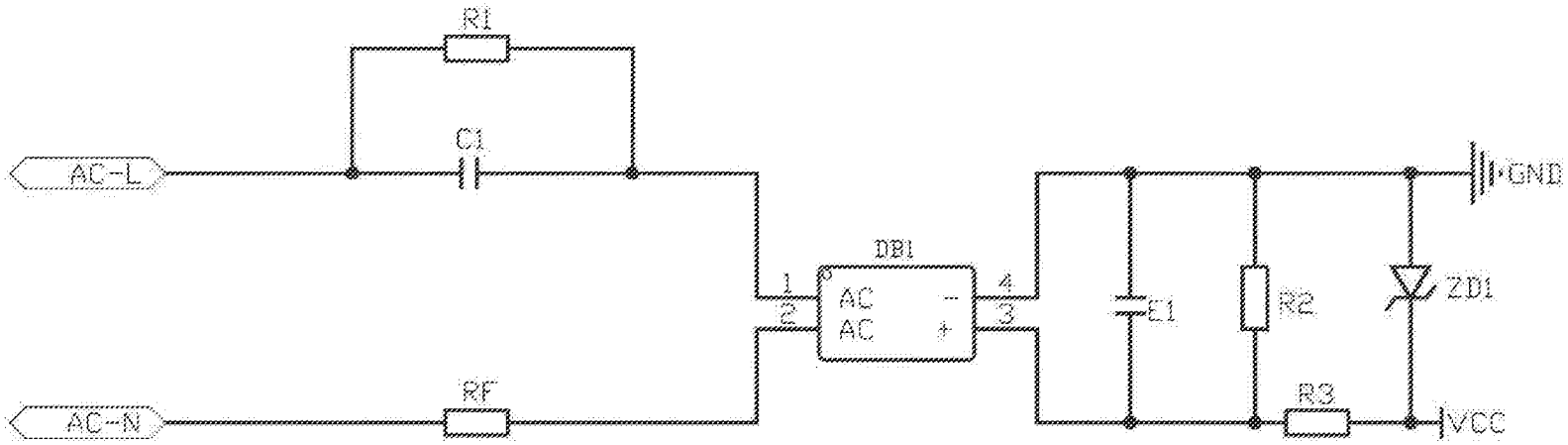
Figure 3:
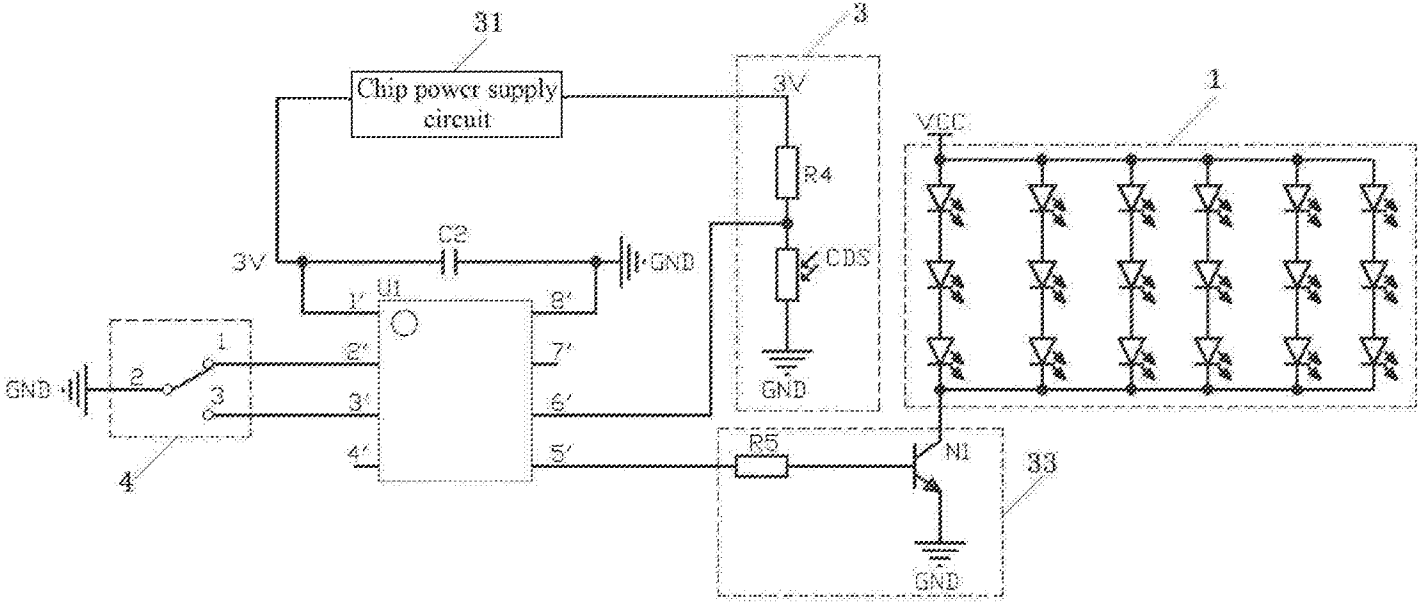
Figure 4:
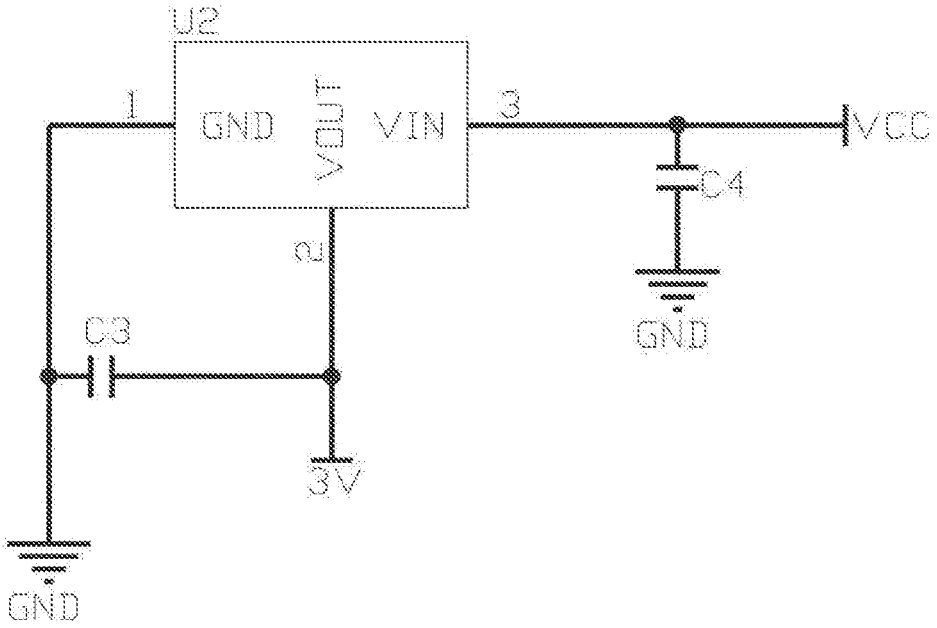

To describe the technical solutions in the embodiments of the present disclosure or in the prior art more clearly, the drawings required for describing the embodiments or the prior art are described briefly below. Obviously, other drawings can be obtained by those of ordinary skill in the art based on these drawings without creative efforts. In the drawings:

FIG. 1 is a composition module diagram of a night light function module in a power strip with a night light function according to an embodiment of the present disclosure;

FIG. 2 is a circuit diagram of a power supply unit in a power strip with a night light function according to an embodiment of the present disclosure;

FIG. 3 is a circuit diagram of a control unit in a power strip with a night light function according to an embodiment of the present disclosure; and FIG. 4 is a circuit diagram of a chip power supply circuit in a power strip with a night light function according to an embodiment of the present disclosure.

DETAILED DESCRIPTION OF THE EMBODIMENTS

The present disclosure is described in detail below with reference to the accompanying drawings and embodiments. Each example is provided to explain the present disclosure instead of limiting the present disclosure. In fact, those skilled in the art will appreciate that modifications and variations may be made in the present disclosure without departing from the scope of the present disclosure. For example, features shown or described as one part of one embodiment may be applied to another embodiment to generate yet another embodiment. Therefore, it is expected that the present disclosure includes such modifications and variations that fall within the scope of the appended claims and their equivalents.

In the description of the present disclosure, orientation or position relationships indicated by terms "longitudinal", "transverse", "upper", "lower", "front", "rear", "left", "right", "vertical", "horizontal", "top", "bottom" and the like are orientation or position relationships shown in the drawings, and these terms are merely for facilitating description of the present disclosure, but not for requiring that the present disclosure must be constructed and operated in a specific orientation, and thus, these terms cannot be understood as a limitation to the present disclosure. As used in the present disclosure, the terms "connected", "connection" and "set" should be understood in a broad sense, for example, they may be fixed connection or detachable connection, they may be direct connection or indirect connection through an intermediate part; or they may be wired connection and wireless connection, or may be connection through a wireless communication signal. For those of ordinary skill in the field, the specific meanings of the terms may be understood according to the specific conditions.

The accompanying drawings show one or more examples of the present disclosure. The detailed description uses reference numerals and letters to refer to the features in the accompanying drawings. Similar numeral references in the drawings and description have been used to refer to the similar parts in the present disclosure. As used herein, the terms "first", "second" and "third" are used interchangeably to distinguish one component from another component, and are not intended to indicate the position or importance of individual components.

To solve the problem of inconvenient use caused by the fact that an existing power strip is difficult to be found in a dark environment and a plug cannot be accurately inserted into a corresponding jack after the power strip is found, the embodiment of the present disclosure firstly provides a power strip with a night light function. The power strip, like the traditional power strip, includes a plug, a movable socket, and a power cord for connecting the plug with the movable socket. The difference is that, as shown in FIG. 1, the power strip is further provided with a night light function module. The night light function module includes: an LED light group 1, a power supply unit 2, a control unit 3 and a mode switching switch 4, where the LED light group 1 is mounted in the plug and/or the movable socket; in order to adapt to the use of the LED light group 1, the plug and the movable socket need to be made of light-transmitting materials; the plug and the movable socket may be entirely made of the light-transmitting materials, or parts, opposite to the LED light group 1, of the plug and the movable socket may be made of the light-transmitting materials; a first input terminal of the power supply unit 2 is connected to a live wire in the plug/movable socket; a second input terminal of the power supply unit 2 is connected to a neutral wire in the plug/socket; a power supply output terminal of the power supply unit 2 is connected to a positive electrode of the LED light group 1; the power supply unit 2 reduces the 220V voltage of the live wire and the neutral wire and then supplies power for the LED light group 1; a power supply terminal of the control unit 3 is connected to the power supply output terminal of the power supply unit 2 and is powered by the power supply unit; an output terminal of the control unit 3 is connected to a negative electrode of the LED light group 1; the control unit realizes on/off control of the LED light group 1 by controlling a negative electrode potential of the LED light group 1; an output terminal of the model switching switch 4 is connected to an input terminal of the control unit 3; the control unit 3 is triggered by the mode switching switch 4 to be switched in automatic, normally open and normally closed control modes, where the automatic mode is to automatically control the LED light group to be turned on/off according to a current light intensity, the normally open mode is to control the LED light group to be turned on all the time, and the normally closed mode is to control the LED light group to be turned off all the time; and the mode switching switch 4 preferably adopts a single-pole double-throw switch and may be mounted on the plug or the movable socket.

The power strip with the night light function is additionally provided with the LED light group, so a night lighting function can be realized, it is convenient for the power strip to be used in dark environments, it is easy to find the position of the power strip, and the plug operation between the plug and the socket is facilitated. The LED light group is powered by the power supply unit led out between the live wire and the neutral wire in the plug/socket. Power supply can be realized as long as the plug of the power strip is connected to a power supply. Furthermore, the work of the LED light group is controlled by the control unit.

The power supply unit 2 in the above embodiment only needs to reduce the 220V voltage between the live wire and the neutral wire in the plug/socket and then supply power for the LED light group. This embodiment provides a specific circuit of a power supply unit 2. Referring to 2, the power supply unit 2 mainly includes a step-down capacitor C1, a first resistor R1, a rectifier bridge DB1, an electrolytic capacitor E1, a second resistor R2, a Zener diode ZD1 and a third resistor R3, where one terminal of the step-down capacitor C1 is connected to a live wire, a maximum current of a product is limited by a capacitive reactance generated by the step-down capacitor C1 under an alternating current signal frequency, the first resistor R1 is connected to two terminals of the step-down capacitor C1 in parallel, one alternating current input terminal of the rectifier bridge DB1 is connected to the other terminal of the step-down capacitor C1, the other alternating current input terminal of the rectifier bridge DB1 is connected to a fusible resistor RF in series and then is connected to a neutral wire, the 220V voltage is reduced by the rectifier bridge DB1, two terminals of the electrolytic capacitor E are connected to a positive output terminal and a negative output terminal of the rectifier bridge DB1, an output of the rectifier bridge is filtered, the second resistor R2 serves as a limiting resistor and is connected to two terminals of the electrolytic capacitor E1 in parallel, a positive electrode of the Zener diode ZD1 is connected to the negative output terminal of the rectifier bridge DB1, a negative electrode of the Zener diode ZD1 is connected to the third resistor R3 and then is connected to the positive output terminal of the rectifier bridge DB1, the Zener diode ZD1 further reduces and stabilizes the voltage output by the rectifier bridge and then supplies power for the LED light group, and the third resistor R3 is used to protect the Zener diode ZD1.

In the application environment where an output voltage of the power supply unit 2 is 11V, a 105J/100V step-down capacitor C1, a 510K first resistor R1, an MB10F rectifier bridge DB1, a 470UF/25V electrolytic capacitor E1, a 4.7K second resistor R2, a 11V Zener diode ZD1 and a 51R third resistor R3 may be chosen. At this time, the power supply unit 2 adopts a resistance capacitance voltage-reducing scheme for a 220V alternating current input, a maximum working current is limited by a capacitive reactance generated by a 1UF step-down capacitor C1, the maximum current which can be generated by the 1UF step-down capacitor C1 is about 70 mA, the voltage is reduced to 50V after passing through the rectifier bridge and then is stabilized by the 11V Zener diode to supply power for the LED light group.

The main functions of the control unit 3 are: automatic, normally open and normally closed modes of the LED light group are controlled. Referring to FIG. 3, the control unit 3 mainly includes a chip power supply circuit 31, a sensing circuit 32, an output circuit 33, a control chip U1 and a power supply capacitor C2, where an input terminal of a chip power supply circuit 31 is connected to a power supply output terminal o the power supply unit 2, a voltage output by the power supply unit 2 is reduced and then supplies power for the control chip U1, the sensing circuit 32 detects an illumination intensity in real time, the output circuit 33 is used to output a control signal of the control chip U1, an output terminal of the output circuit 33 is connected to a negative electrode of the LED light group 1, a power supply pin of the control chip U1 is connected to a power supply output terminal of the chip power supply circuit 31, power is supplied by the chip power supply circuit 31, the power supply pin of the control chip U1 is further connected to the power supply capacitor C2, an output terminal of the control chip U1 is connected to an input terminal of the output circuit 33 to output a control signal, an input pin of the control chip U1 is connected to the output terminal of the mode switching switch 4 and an output terminal of the sensing circuit 32 respectively, the control chip U1 is triggered by the mode switching switch 4 to switch control modes, and when the control mode of the control chip U1 is an automatic mode, the control chip U1 controls the LED light group 1 to be turned on/off according to a detection signal transmitted by the sensing circuit 32.

Referring to FIG. 4, the chip power supply circuit 31 mainly includes a voltage-stabilizing chip U2, a third capacitor C3 and a fourth capacitor C4, where a power supply pin of the voltage-stabilizing chip U2 is connected to the power supply output terminal of the power supply unit 2, an output voltage of the power supply unit 2 is reduced to 3V to supply power to the control chip U1, one terminal of the third capacitor C3 is connected to a grounding pin of the voltage-stabilizing chip U2 and the other terminal of the third capacitor C3 is connected to a voltage output pin of the voltage-stabilizing chip U2, one terminal of the fourth capacitor C4 is connected to the power supply pin of the voltage-stabilizing chip U2 and the other terminal of the fourth capacitor C4 is grounded, the third capacitor C3 may choose a capacitor of 10UF/16V, and the fourth capacitor C4 may choose a capacitor of 10UF/25V.

Referring to FIG. 3, the sensing circuit 32 includes a fourth resistor R4 and a photoresistor CDS, where the fourth resistor R4 serves as a voltage-dividing resistor, one terminal of the fourth resistor R4 is connected to the power supply output terminal of the chip power supply circuit 31, and one terminal of the photoresistor CDS is grounded and the other terminal of the photoresistor CDS is connected to the other terminal of the fourth resistor R4 and the input pin of the control chip U1 respectively. The working principle of the sensing circuit 32 is: photosensitive detection is performed by the photoresistor CDS; when the detected light intensities are different, the resistance value of the photoresistor CDS will change correspondingly; voltages loaded at two terminals of the fourth resistor R4 and two terminals of the photoresistor CDS are still a power supply voltage output by the chip power supply circuit 31, so when the resistance of the photoresistor CDS changes, a potential at a position where the photoresistor CDS is connected to the fourth resistor R4 will change; the control chip U1 may convert a corresponding light intensity according to different potentials at the position, then corresponding light intensity is compared with a threshold, and on/off of the LED light group is controlled according to the comparison result in the automatic control mode. The fourth resistor R4 may choose a 750K resistor, and the photoresistor CDS may choose a 5528 photoresistor.

Referring to FIG. 3, the output circuit 33 includes a fifth circuit R5 and a triode N1, where one terminal of the fifth resistor R5 is connected to the output pin of the control chip U1, a base electrode of the triode N1 is connected to the other terminal of the fifth resistor R5, an emitter electrode of the triode N1 is grounded, a collector electrode of triode N1 is connected to the negative electrode of the LED light group 1, the fifth resistor R5 is mainly used to protect the triode N1 and may choose a 220R resistor, and the triode N1 is a J3Y triode.

In order to adapt to the 11V power supply voltage output by the power supply unit, in this embodiment, the LED light group 1 is formed by six LED light strings connected in parallel, and each of the LED light strings is formed by three LED light strings connected in series.

After considering the specification and practicing the disclosure disclosed herein, those skilled in the art would readily conceive of other embodiments of the present disclosure. This application is intended to cover any variations, uses or adaptive changes of the present disclosure. These variations, uses or adaptive changes follow the general principle of the present disclosure and include common general knowledge or conventional technical means in the technical field that are not disclosed in the present disclosure. The specification and the embodiments are merely regarded as exemplary, and the real scope and spirit of the present disclosure are indicated by the following claims.

It should be understood that the present disclosure is not limited to the precise structure described above and shown in the drawings, and various modifications and changes may be made without departing from its scope. The scope of the present disclosure is limited only by the appended claims. The foregoing is merely illustrative of the preferred embodiments of the present disclosure and is not intended to limit the present disclosure, and various changes and modifications may be made by those skilled in the art. Any modifications, equivalent substitutions, improvements, etc. made within the spirit and scope of the present disclosure should be included within the protection scope of the present disclosure.

The invention claimed is:

1. A power strip with a night light function, comprising a plug, a movable socket, and a power cord for connecting the plug with the movable socket, and further comprising a night light function module, wherein the night light function module comprises an LED light group, a power supply unit, a control unit and a mode switching switch;

the LED light group is mounted in the plug and/or the movable socket;

a first input terminal of the power supply unit is connected to a live wire in the plug/movable socket, a second input terminal of the power supply unit is connected to a neutral wire in the plug/movable socket, and a power supply output terminal of the power supply unit is connected to a positive electrode of the LED light group;

a power supply terminal of the control unit is connected to the power supply output terminal of the power supply unit, an output terminal of the control unit is connected to a negative electrode of the LED light group, and the control unit realizes on/off control of the LED light group by controlling a negative electrode potential of the LED light group; and an output terminal of the mode switching switch is connected to an input terminal of the control unit, the control unit is triggered by the mode switching switch to be switched in automatic, normally open and normally closed control modes, the automatic mode is to automatically control the LED light group to be turned on/off according to a current light intensity, the normally open mode is to control the LED light group to be turned on all the time, and the normally closed mode is to control the LED light group to be turned off all the time.

2. The power strip with the night light function according to claim 1, wherein the power supply unit comprises: a step-down capacitor, a first resistor, a rectifier bridge, an electrolytic capacitor, a second resistor, a Zener diode and a third resistor, one terminal of the step-down capacitor is connected to the live wire;

the first resistor is connected to two terminals of the step-down capacitor in parallel;

one alternating current input terminal of the rectifier bridge is connected to the other terminal of the voltage-stabilizing capacitor, and the other alternating current input terminal is connected to a fusible resistor and then is connected to the neutral wire;

two terminals of the electrolytic capacitor are connected to a positive output terminal and a negative output terminal of the rectifier bridge respectively;

the second resistor is connected to two terminals of the electrolytic capacitor in parallel; and a positive electrode of the Zener diode is connected to the negative output terminal of the rectifier bridge, and a negative electrode of the Zener diode is connected to the third resistor and then is connected to the positive output terminal of the rectifier bridge.

3. The power strip with the night light function according to claim 1, wherein the control unit comprises: a chip power supply circuit, a sensing circuit, an output circuit, a control chip and a power supply capacitor, an input terminal of the chip power supply circuit is connected to the power supply output terminal of the power supply unit, and a voltage output by the power supply unit is reduced to supply power for the control chip;

the sensing circuit detects an illumination intensity in real time;

the output circuit is used to output a control signal of the control chip, and an output terminal of the output circuit is connected to the negative electrode of the LED light group;

a power supply pin of the control chip is connected to a power supply output terminal of the chip power supply circuit, power is supplied by the chip power supply circuit, the power supply pin of the control chip is further connected to the power supply capacitor, an output terminal of the control chip is connected to an input terminal of the output circuit to output a control signal; an input pin of the control chip is connected to the output terminal of the mode switching switch and an output terminal of the sensing circuit, the control chip is triggered by the mode switching switch to switch control modes, and when the control mode of the control chip is an automatic mode, the control chip controls the LED light group to be turned on and off according to a detection signal transmitted by the sensing circuit.

4. The power strip with the night light function according to claim 3, wherein the chip power supply circuit comprises: a voltage-stabilizing chip, a third capacitor and a fourth capacitor, a power supply pin of the voltage-stabilizing chip is connected to the power supply output terminal of the power supply unit to reduce a voltage output by the power supply unit;

one terminal of the third capacitor is connected to a grounding pin of the voltage-stabilizing chip and the other terminal of the third capacitor is connected to a voltage output pin of the voltage-stabilizing chip; and one terminal of the fourth capacitor is connected to the power supply pin of the voltage-stabilizing chip and the other terminal of the fourth capacitor is grounded.

5. The power strip with the night light function according to claim 3, wherein the sensing circuit comprises: a fourth resistor and a photoresistor, one terminal of the fourth resistor is connected to the power supply output terminal of the chip power supply circuit; and one terminal of the photoresistor is grounded, and the other terminal of the photoresistor is connected to the other terminal of the fourth resistor and an input pin of the control chip.

6. The power strip with the night light function according to claim 3, wherein the output circuit comprises: a fifth resistor and a triode;

one terminal of the fifth resistor is connected to an output pin of the control chip; and a base electrode of the triode is connected to the other terminal of the fifth resistor, an emitter electrode of the triode is grounded, and a collector electrode of the triode is connected to the negative electrode of the LED light group.

7. The power strip with the night light function according to claim 1, wherein the LED light group is formed by six LED light strings connected in parallel, and each of the LED light strings is formed by three LED light strings connected in series.

8. The power strip with the night light function according to claim 1, wherein the mode switching switch is a single-pole double-throw switch.

* * * * *